US005557377A

United States Patent [19]

Loewen et al.

[11] Patent Number: 5,557,377

[45] Date of Patent: Sep. 17, 1996

[54] SINGLE PASS, IN-LINE COLOR ELECTROPHOTOGRAPHIC PRINTER WITH INTERSPERSED ERASE DEVICE

[75] Inventors: Victor D. Loewen; Thomas Camis; Kenneth A. Lindblom, all of Boise, Id.

[73] Assignee: Hewlett-Packard Company, Palo Alto, Calif.

[21] Appl. No.: 455,011

[22] Filed: May 30, 1995

[51] Int. Cl.[6] ..... G03G 15/01; G03G 15/10

[52] U.S. Cl. ..... 355/256; 355/326 R; 347/118

[58] Field of Search ..... 355/256, 326 R, 355/327; 347/115, 116, 117, 118; 430/42, 43, 45, 117

[56] References Cited

U.S. PATENT DOCUMENTS

| | | | |
|---|---|---|---|
| 4,599,285 | 7/1986 | Haneda et al. | 430/54 |
| 4,788,574 | 11/1988 | Matsumoto et al. | 355/4 |
| 4,905,047 | 2/1990 | Ariyama | 355/256 |
| 4,959,695 | 9/1990 | Nishimura et al. | 355/327 |
| 5,016,062 | 5/1991 | Rapkin | 355/327 |
| 5,300,990 | 4/1994 | Thompson | 355/256 |
| 5,314,774 | 5/1994 | Camis | 430/47 |
| 5,394,232 | 2/1995 | Tamura et al. | 355/327 |

FOREIGN PATENT DOCUMENTS

| | | | |
|---|---|---|---|
| 0599296A1 | 6/1994 | European Pat. Off. . | |
| 5-307307 | 11/1993 | Japan | 355/327 |

*Primary Examiner*—Joan H. Pendegrass

[57] ABSTRACT

A single pass EP color printer includes a photoreceptor web having multiple layers and including a charge transport layer and a charge generation layer. Four exposure devices (e.g. either laser-based or thin film electroluminescent edge emitting (TFEL) devices) are serially arrayed along the photoreceptor web and act to expose the photoreceptor web in accordance with cyan, magenta, yellow and black color image pixel data. A liquid toner developer module is associated with each exposure device and includes a liquid toner reservoir, a developer roll for carrying the liquid toner to a transfer point and a squeegee roll. Each developer module is fixed so as to position its developer roll at a constant prescribed distance from the photoreceptor web at the toner transfer point and to create a fluid interfacial layer between its developer roll and the photoreceptor web. In addition, each squeegee roll is maintained in constant contact with the photoreceptor web. Erasure devices and corona charging devices are positioned between the respective developer modules to enable preparation of the photoreceptor web for a subsequent exposure/development operation. A drying roll is positioned after a last developer module for fixing the imaged toner on the photoreceptor web. The exposure devices operate from either the lower side of the photoreceptor web or from the upper side; however, in the latter instance, the photoreceptor web is comprised of a transparent support and ground plane layer. Additional embodiments of the invention are disclosed which employ a dielectric powder toner and a liquid toner four pass system.

9 Claims, 8 Drawing Sheets

SINGLE PASS, IN-LINE COLOR ELECTROPHOTOGRAPHIC PRINTER WITH INTERSPERSED ERASE DEVICE

FIELD OF THE INVENTION

This invention relates to color electrophotographic printers and, more particularly, to both single and multiple pass color EP printers exhibiting improved performance characteristics.

BACKGROUND OF THE INVENTION

The prior art includes many teachings of full color electrophotographic (EP) printer configurations. Many color EP printers employ a four-pass configuration wherein four developer modules are arrayed along a photoreceptor surface. The developer modules are allocated to the deposition of cyan, yellow, magenta, and black toners onto the moving photoreceptor surface. A charging station uniformly sensitizes the photoreceptor surface. An exposure station selectively discharges the photoreceptor surface in accordance with respective color plane image data, The photoreceptor surface is then passed over the developer modules, with one developer module being brought into engagement with the photoreceptor surface to allow development of one color of the exposed image. The developed photoreceptor image then experiences a full rotation, is again exposed in accord with next color plane data and the re-exposed image is again developed, using the next color. The procedure continues until four passes have occurred and the entire full color image is present on the photoreceptor. An image transfer action then occurs whereby the color-toned image is transferred to a sheet which then issues from the printer. U.S. Pat. No. 5,314,774 to Camis discloses such a system and employs a plurality of dry powder, color toner developer modules to enable the operation of a four-pass color printer. The Camis apparatus employs a non-magnetic toner which enables the use of dot-on-dot image development.

U.S. Pat. No. 5,300,990 to Thompson illustrates a liquid EP printer developer module and further describes (see FIG. 3) that such developer modules can be positioned side-by-side beneath a web-photoreceptor. The Thompson patent does not disclose whether the liquid EP system is single pass or four pass. Once the image in the Thompson system is fully developed on the photoreceptor surface, it is transferred to a sheet of paper or to an intermediate transfer medium.

U.S. Pat. No. 5,016,062 to Rapkin discloses a multicolor EP printer which includes four secondary imaging drums that are positioned along the path of an endless web. In accordance with the multi-color image to be produced, each drum is appropriately exposed in accordance with data from a single color plane and a paper sheet is passed in contact therewith via the endless web to enable toner transfer. After the sheet has contacted all of the secondary imaging drums, it contains a full color image. A similar system is shown in U.S. Pat. No. 4,905,047 to Ariyama, however, the Ariyama system employs a liquid toner to achieve the imaging of the respective secondary drums. U.S. Pat. No. 4,788,574 to Matsumoto et al. also discloses a four-drum/conveyor belt developer system for an in-line color printer.

To increase the speed of EP apparatus, the prior art has suggested single-pass color-printers. European Patent 0 599 296 to Fukuchi et al. illustrates a single pass color copier which includes a four plane memory for storing yellow, magenta, cyan and black pixel data. In one embodiment, Fukuchi et al. use a web photoreceptor having a plurality of liquid toner developer modules arrayed along one surface. Between each developer module, a laser beam images the web photoreceptor in accordance with a particular color plane's pixel data. Immediately after each imaging action, a development occurs in accordance with the charge states on the web photoreceptor. Next, the web photoreceptor is again charged and developed in accordance with a next color plane's image data. The procedure continues until all four image planes have been exposed and developed, at which point the image is transferred to a paper sheet. Fukuchi et al. employ powder toners to achieve their individual color toning actions.

U.S. Pat. No. 4,599,285 to Haneda et al. discloses an EP apparatus wherein plural developers are positioned along a photoreceptor web, with each developer module employing a two-component powder toner. Electrostatic recording heads are positioned between the individual developer modules to allow a writing of pixel charge states on the photoreceptor web in accordance with particular color plane data.

While it is known that the speed of a single pass color EP printer can be made four times faster than a four-pass print architecture, single-pass EP color printers present a number of problems. It is difficult to assure proper registration of subsequent image color planes if the photoreceptor web is subject to speed variations as a result of engagement and disengagement of developer modules. Web speed variations cause a "banding" in the image and are to be avoided. In EP color printers that employ liquid toners, a line of fluid is created by surface tension of the toner carrier when a wetted roller or blade is removed from the surface of the photoreceptor. Means are generally provided to remove the "drip" line so as to prevent it from contaminating the system. Further, complex apparatus is required to enable engagement and disengagement of developer modules and transfer rollers from the photoreceptor web. The speed of the EP printer is further dependent upon the time it takes to disengage a developer module and engage a next developer, etc.

Accordingly, it is an object of this invention to provide a single-pass, full color EP printer exhibiting an improved architecture and speed of operation.

It is another object of this invention to provide an improved full-color EP printer that employs liquid toner developer modules, but avoids drip lines on the photoreceptor.

It is a further object of this invention to provide an improved full color EP printer wherein mechanisms to engage and disengage developer modules are avoided.

SUMMARY OF THE INVENTION

A single pass EP color printer includes a photoreceptor web having multiple layers and including a charge transport layer and a charge generation layer. Four exposure devices (e.g. either laser-based or thin film electroluminescent edge emitting (TFEL) devices) are serially arrayed along the photoreceptor web and act to expose the photoreceptor web in accordance with cyan, magenta, yellow and black color image pixel data. A liquid toner developer module is associated with each exposure device and includes a liquid toner reservoir, a developer roll for carrying the liquid toner to a transfer point and a squeegee roll. Each developer module is fixed so as to position its developer roll at a constant prescribed distance from the photoreceptor web at the toner transfer point and to create a fluid interfacial layer between its developer roll and the photoreceptor web. In addition, each squeegee roll is maintained in constant contact with the photoreceptor web. Erasure devices and corona charging devices are positioned between the respective developer modules to enable preparation of the photoreceptor web for a subsequent exposure/development operation. A drying roll is positioned after a last developer module for fixing the imaged toner on the photoreceptor web. The exposure devices operate from either the lower side of the photoreceptor web or from the upper side; however, in the latter instance, the photoreceptor web is comprised of a transparent support and ground plane layer. Additional embodiments of the invention are disclosed which employ a dielectric powder toner and a liquid toner four pass system.

DETAILED DESCRIPTION OF THE INVENTION

Figure 1:
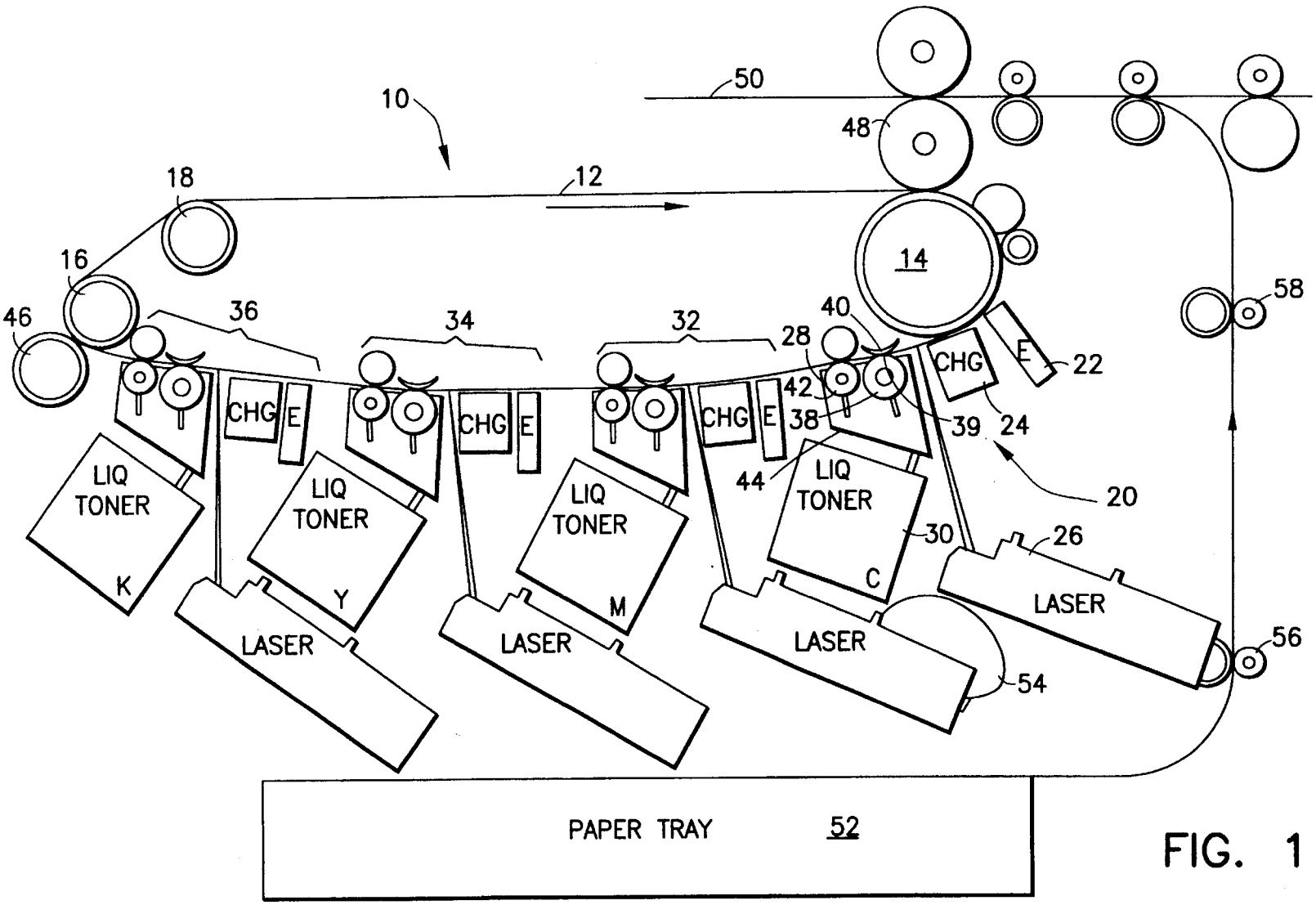
FIG. 1 is a schematic showing a first embodiment of a liquid toner EP printer constructed in accordance with the invention.

FIG. 1 illustrates a schematic representation of a single-pass, liquid toner, multi-color, EP printer 10 incorporating the invention. A photoreceptor web 12 is positioned over drive roller 14 and follower rollers 16 and 18. Photoreceptor web 12 is further engaged by four separate developer stations, each developer station being structurally identical but applying a different color liquid toner to photoreceptor web 12. Each developer station (e.g. 20) includes an erase head 22, a corona charge module 24, a scanned laser write head 26, a developer module 28 and a liquid toner reservoir 30. Reservoir 30, in the example shown in FIG. 1, contains a cyan liquid toner including both a toner component and a dispersant component (e.g. Isopar™ or Norpar™, as available from the Exxon Corporation). Additional developer stations, 32, 34, and 36 are arrayed linearly along photoreceptor web 12 and provide exposure and developing functions for magenta, yellow and black toners. Developer station 20 will be hereafter described in detail, but it is to be understood that each of developer stations 32, 34 and 36 is substantially identical and performs similar functions.

While not shown, those skilled in the art will realize that EP printer 10 includes a processor and a resident memory, which includes memory planes reserved for pixel data representing cyan, magenta, yellow and black pixel data that is to printed. For the example shown in FIG. 1, data resident in the processor's memory that is representative of cyan pixel data is fed (in signal form) to laser 26 which is, in turn, scanned across photoreceptor web 12 to create corresponding pixel charge states thereon. Prior to the scan action, an erase head 22 is operated to discharge photoreceptor web 12. Erase head 22 preferably comprises a light source that spans the width of photoreceptor web 12 and causes an erasure of previously written pixel data. Immediately following erase head 22 is a corona charge module 24 which causes photoreceptor web 12 to achieve a uniform charge state across its width.

Figure 1A:
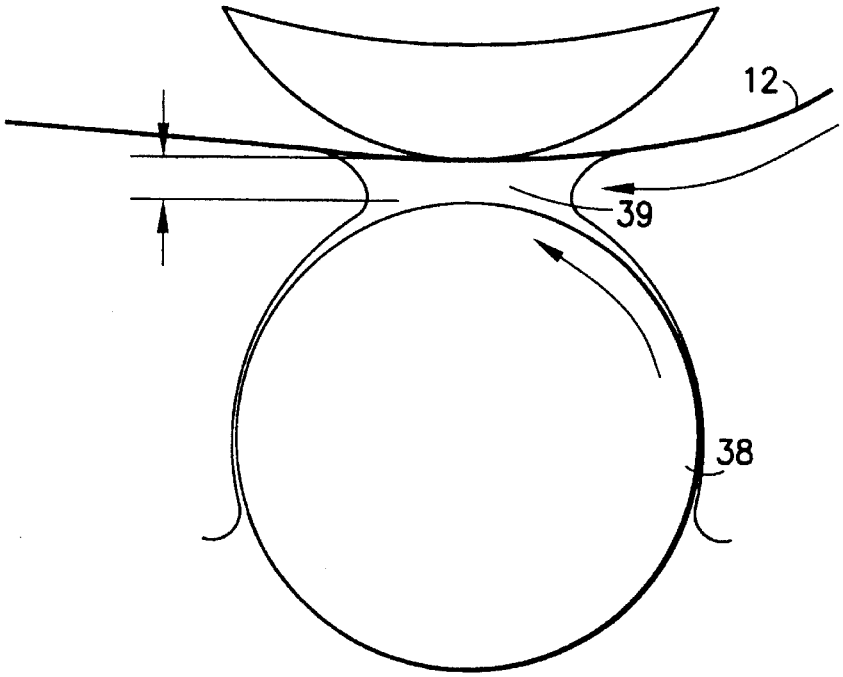
FIG. 1*a* is an enlarged view of the developer roll/photoreceptor web nip.

After corona charge module 24 has charged photoreceptor web 12 to a uniform charge state, laser module 26 is scanned to write a cyan pixel image across the width of photoreceptor web 12. Thereafter, the image-containing portion of photoreceptor web 12 is moved through developer module 28 which, in this preferred embodiment, is in continual engagement with photoreceptor web 12. Developer module 28 is supplied with cyan liquid toner from liquid toner reservoir 30. Developer roll 38 receives the cyan liquid toner and entrains that toner around its outer periphery to a transfer point 39. As shown in FIG. 1*a*, developer roll 38 is not in physical contact with photoreceptor web 12 but is spaced therefrom by a prescribed distance so as to create a fluid interfacial layer at transfer point 39 so as to enable migration of toner particles in the liquid toner to the appropriately discharged areas on photoreceptor web 12. The distance between photoreceptor web 12 and developer roll 38 is assured by proper adjustment of a cam 40.

Immediately following developer roll 38 is a squeegee roll 42 which rotates in a direction coincident with the direction of movement of photoreceptor web 12. Squeegee roll 42 enables the removal of a substantial percentage of the solvent from the toner present on photoreceptor web 12 and enables the cyan-toned image to emerge from developer module 28 in a substantially dry state. In fact, it has been found that the exiting cyan-toned image is sufficiently dry, given proper adjustment of developer module 28, to enable an immediate subsequent toning by a further liquid toner.

Excess liquid toner from the toning and squeegee actions in toner module 28 is captured by an enclosure 44 and is returned to liquid toner reservoir 30 for reuse. Each of the developer modules in developer stations 20, 32, 34, and 36 remains in constant engagement with photoreceptor web 12. As a result, no load variations occur on photoreceptor web 12 due to engagement and disengagement of the respective developer modules. Further, no drip line is created by disengagement of a developer module from photoreceptor web 12. In addition, there is no requirement for individual drying rolls to be positioned between the respective developer stations. For that reason, only a single drying roll 46 is present at the outlet from developer station 36.

As above indicated, each of developer stations 20, 32, 34 and 36 is functionally equivalent except that each is responsive to data from a different color plane within the memory of printer 10. Thus, after developer station 20 has completed its toning of the cyan pixel data on photoreceptor web 12, the toned image is moved to developer station 32 where photoreceptor web 12 is charged and exposed in accord with magenta pixel data and is then appropriately toned with magenta toner. Subsequently, the cyan/magenta toned image is moved to developer stations 34 and 36 where the image receives both yellow and black image data and toning. Thereafter, the fully toned image passes beneath drying roll 36 (which is heated and applies pressure) and then passes to an intermediate transfer roller 48 where the image is transferred to a sheet 50. Sheet 50, as is known in the art, is fed from a paper tray 52 under control of a rotatable cam 54 and feed rollers 56, 58, etc.

Figure 2:
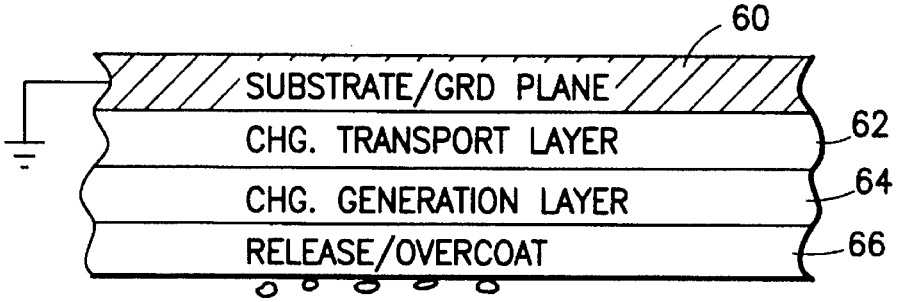
FIG. 2 is a sectional view of an inverted dual layer photoreceptor wherein optical exposure occurs through the release/overcoat layer.

Referring to FIG. 2, a cross section is shown of a preferred embodiment of photoreceptor web 12. A substrate/ground plane 60 forms a support layer and has arrayed on it a charge transport layer 62, a charge generation layer 64 and a release/overcoat layer 66. Charge generation layer 64 responds to incident laser light to generate corresponding charge pairs. Charge transport layer 62 provides a charge travel path which allows migration of certain charges states to ground plane 60 while other charge states migrate to the interface between charge generation layer 64 and release/overcoat layer 66. Because charge generation layer 64 is very close to the surface of photoreceptor belt 12 and is extremely thin, its speed of photo response is excellent. Further, ghosting effects are minimized due to the thinness of charge generation layer 64 and the higher penetration of light during both exposure and erasing actions. Exemplary thicknesses for the layers are as follows: charge generation layer 64: 0.1 micron, charge transport layer 62: 15 microns. A preferred material for the charge generation layer is a metal-free phthalocyanine. The charge transport layer is comprised of charge transport molecules dispersed in an inert binder. Further details regarding a photoreceptor such as shown in FIG. 2 can be found in Organic Photoconductors For Imaging System, Borsenberger et al., Published by M. Dekker Inc., New York (1993).

Figure 4:
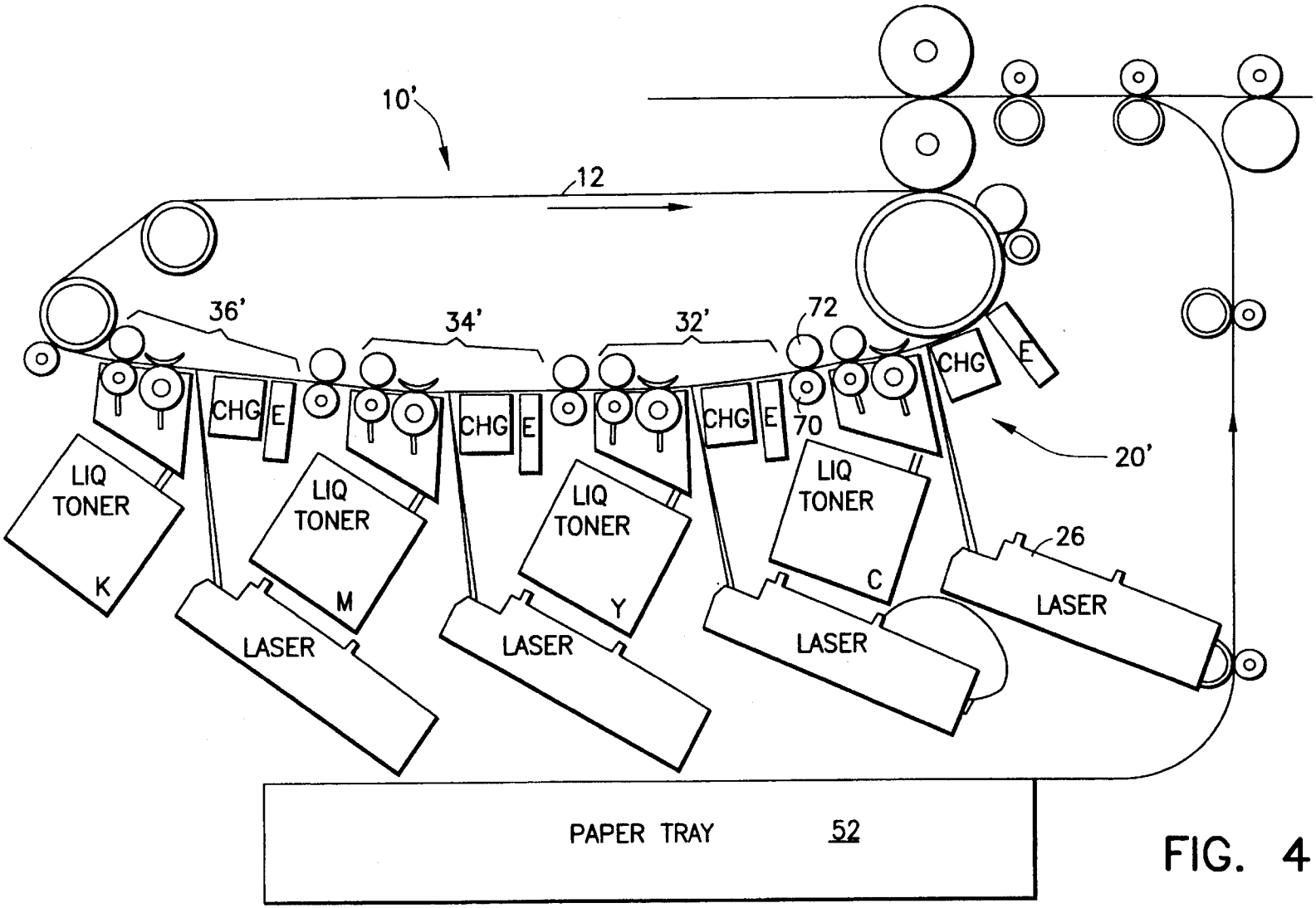
FIG. 4 is an embodiment of the invention of FIG. 1 wherein a drying roll is positioned between each developer module.

As above indicated, developer modules 28, if properly adjusted, assure that toned images exiting therefrom are sufficiently dry to receive additional layers of toner. To lessen the adjustment requirements, the modified structure shown in FIG. 4 is employed. Each of developer stations 20', 32', 34', and 36' is structurally identical to that shown in FIG. 1, except that each developer station now includes a drying roll 70 and a mating roll 72. The inclusion of a drying roll 70 with each developer station, increases the overall length and complexity of the printer structure but provides further assurance that a dry toned surface will enter a subsequent developer station. Mating rolls 72 assure that belt 12 is pressed against drying roll 70 with sufficient pressure so that the toner present on photoreceptor web 12 is fixed by a combination of the pressure and heat applied via drying roll 70.

The EP printers shown in FIG. 1 and FIG. 4 employ scanned laser modules 26 to achieve desired pixel charge states on photoreceptor web 12. Since a single pass color printer requires a subsequent color plane image to be precisely registered with a previously toned color image, it is critical that the placement of laser modules 26 be precisely controlled. Further, laser scanners exhibit errors of scale, bow, linearity and intensity that need to be matched and adjusted. Additionally, laser scanners are subject to vibration and other environmental effects which may cause registration problems. The use of a TFEL device obviates many of the problems associated with the laser scanner.

Figure 5:
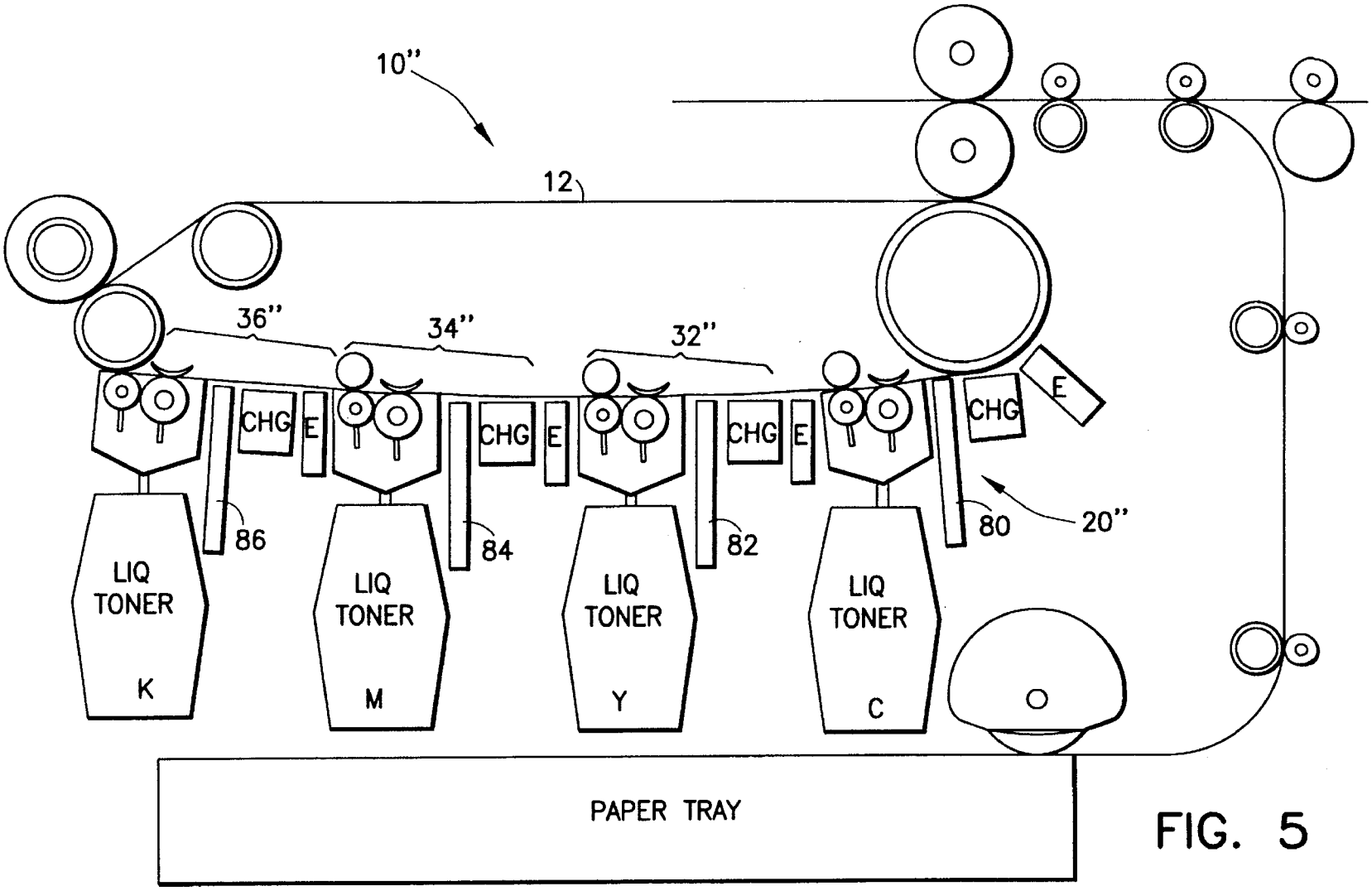
FIG. 5 is a schematic embodiment of the invention wherein the photoreceptor is exposed by a TFEL device.
Figure 6:
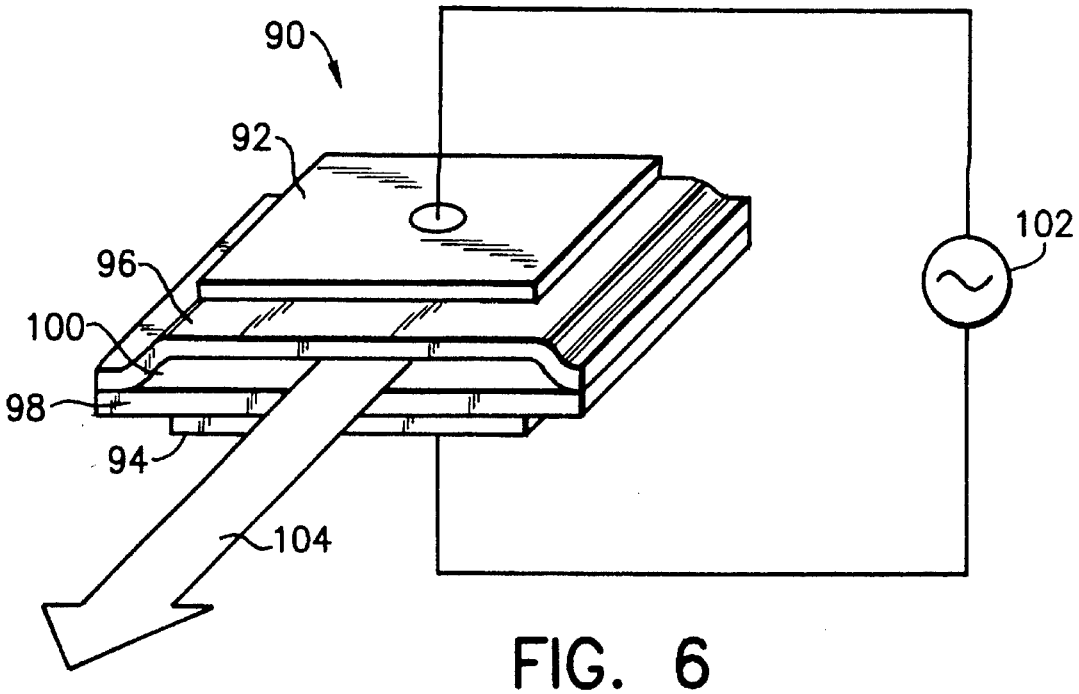
FIG. 6 illustrates a TFEL device.

In FIG. 5, a single pass multicolor printer 10' includes TFEL exposure devices 80, 82, 84 and 86. Each TFEL device replaces a laser and its associated scanning mechanism and serves to expose photoreceptor web 12 in accordance with pixel data as aforedescribed. In FIG. 5, each developer station 20", 32", 34", 36" is identical to that shown in FIG. 1, except that the resident laser module 26 has been replaced by a TFEL image exposure device. In FIG. 6, a perspective view of a preferred TFEL image exposure device 90 is shown and it comprises a pair of metal electrodes 92, 94, interposed dielectric layers 96 and 96 and an active layer 100. Active layer 100 is preferably a doped zinc sulfide layer which exhibits an electroluminescent action when a proper signal is applied across metal electrodes 92, 94 from a signal source 102. Upon such excitation, active layer 100 emits light from the TFEL device's exposed edge in the direction of arrow 104.

Figure 7:
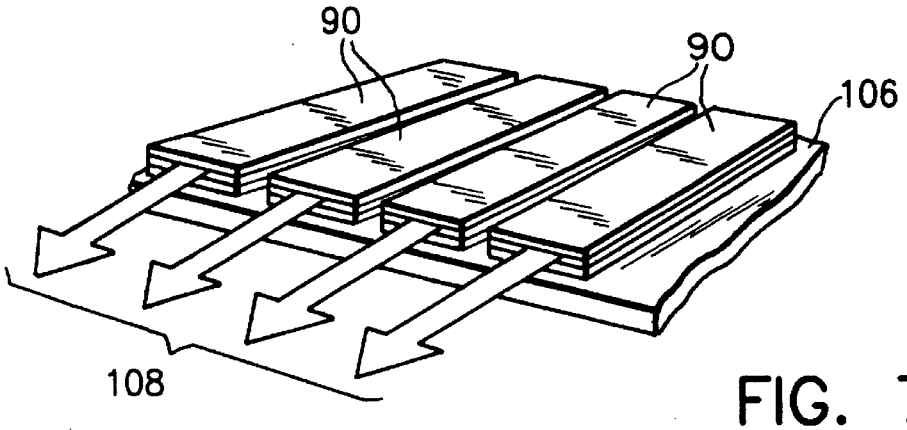
FIG. 7 illustrates an array of TFEL devices.

In FIG. 7, a plurality of TFEL devices 90 are mounted on a substrate 106 to enable a plurality of light beams 108 to be simultaneously produced in response to pixel image data (the circuitry for exciting TFEL devices 90 is not shown). Further details regarding the characteristics of TFEL exposure devices 90 can be found in: "Thin Film Electroluminescent Edge Emitter: The Imaging Station of the Future", Leksell, 5th Annual Photoreceptor and Copier Components Conference, Imaging Materials Seminar Series, Santa Barbara, 1989.

Because TFEL exposure devices 90 can be rigidly mounted and do not exhibit the nonlinearities of scanned laser devices, their use in single pass color printer 10" enables maintenance of excellent registration between subsequently toned color plane images.

In a single pass color printer such as shown in FIG. 5, TFEL exposure devices 82, 84, and 86 must expose photoreceptor web 12 through intervening toner deposits already on the web. The intervening deposits reduce the amount of exposure light which penetrates to the charge generation layer of photoreceptor web 12 and thereby slows the overall exposure process—with an attendant affect on speed of operation of the printer. Further, because of the substantial amount of paper which moves within printer 10, paper dust accumulates on the outer surface of photoreceptor web 12 and can occlude light from impinging on the photoreceptor. These problems can be overcome by employing an altered photoreceptor web configuration and placing each of the TFEL exposure devices above the upper surface of photoreceptor web 12.

Figure 8:
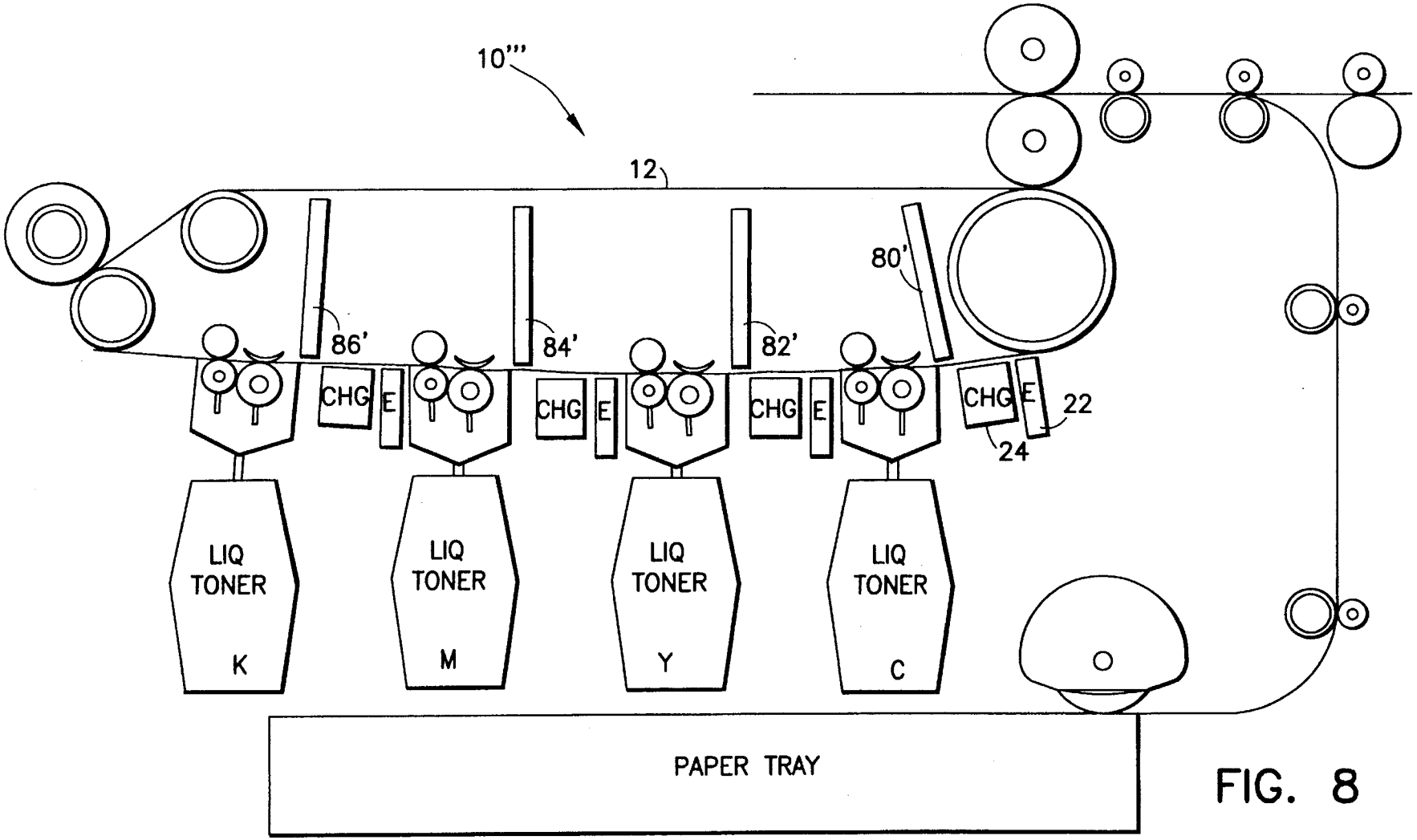
FIG. 8 is a schematic embodiment of the invention wherein TFEL devices are employed to expose the photoreceptor, but from an upper surface thereof.

Such a configuration is shown in FIG. 8 wherein each of TFEL exposure devices 80', 82', 84', and 86' have been shifted from the position shown in FIG. 5 into the interior area within photoreceptor web 12. In the system shown in FIG. 8, since discharge area development is preferred and the preferred liquid toner is positively charged, a positive charging photoreceptor 12 is required as shown schematically in FIG. 3. Since image exposure of photoreceptor web 12 is from its upper side, support 110 is made transparent to the wavelength of light emitted by TFEL image exposure devices 80', 82', 84', and 86'. Support 110 is supported on a transparent ground plane 112 which is in turn stacked on a charge transport layer 114, a charge generation layer 116, and a release/overcoat layer 118. Toner particles 120 are present on the lowermost surface of release/overcoat layer 118.

Figure 3:
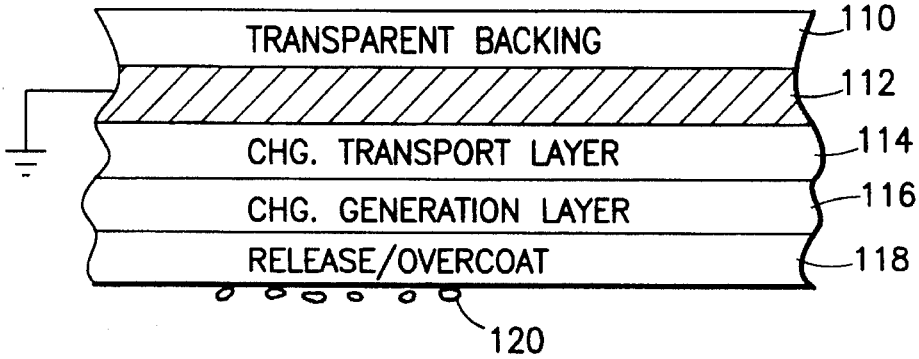
FIG. 3 is a section of an inverted dual layer photoreceptor wherein exposure occurs through a transparent support.

In operation, photoreceptor web 12, when taking the structure shown in FIG. 3, is initially subjected to an erase module 22 which, because release/overcoat layer 118 is at least partially light transparent at the emitted wavelength enables establishment within charge generation layer 116 of electron-hole pairs in the manner known in the art. Thereafter, a corona charge module 24 acts to emplace a uniform charge on the surface of release/overcoat layer 118. Then, a TFEL image exposure device (e.g. 80') is controlled to selectively expose photoreceptor web 12 through transparent support 10 and ground plane 112. As a result, electron-hole pairs are selectively altered within charge generation layer 116 in accordance with the light pattern impressed thereupon. Due to the positive charge polarity on the surface of release/overcoat layer 118, positive polarity charge states migrate to ground plane 112 while negative polarity charge states migrate to the interface between charge generation layer 116 and release/overcoat layer 118. Thereafter, photoreceptor belt 12 is moved into contact with a developer module and development occurs in the manner aforedescribed.

By placing the TFEL image exposure devices within the interior of photoreceptor web 12, no longer do TFEL exposure devices 82', 84' and 86' need to expose a charge generation layer through a toner layer (since the toner layer lies on the lowermost surface of release/overcoat layer 118 and the light exposure comes through transparent support 110). Furthermore, the interior surface of photoreceptor web 12 is maintained in a cleaner state as it is more sheltered with respect to paper dust.

Figure 9:
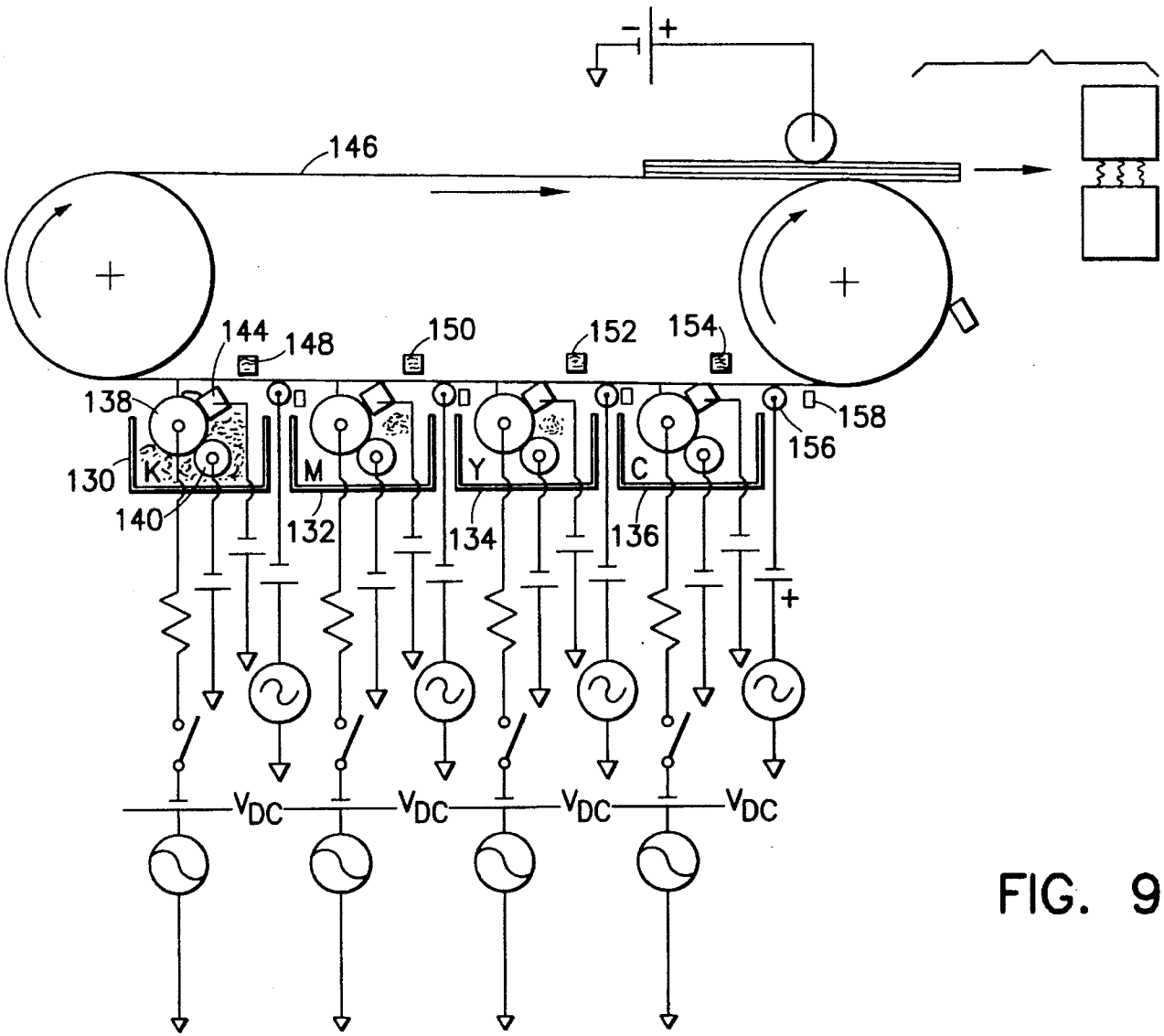
FIG. 9 is a schematic view of a single-pass dry toner EP printer which employs TFEL devices.

In FIG. 9, an embodiment of the invention is illustrated which employs a negatively charged, dry powder, single component, dielectric toner. Each of developer modules 130, 132, 134 and 136 is structurally identical and includes a developer roller 138, a toner charging roller 140 and metering blade 144. Each developer module 130, 132, etc. is identical in structure to that shown in U.S. Pat. No. 5,314,774, the disclosure of which is incorporated herein by reference.

In the known manner, each developer module applies the dry powder toner to photoreceptor web 146 in accordance with pixel charge states resident thereon. In this case, photoreceptor web 146 is constructed to have a transparent backing layer and ground plane so as to enable backside exposure. The photo conductive layer may be one of a variety of well known negatively charging photo conductors. Oriented above the upper side of photoreceptor web 146 are a plurality of TFEL image exposure devices 148, 150, 152 and 154 which are, in structure and operation, identical to those shown in FIG. 8 and FIGS. 6 and 7. Immediately upstream from each developer module is a photoreceptor charging roller 156 and an erase head 158. Further details of remaining portions of the system are discussed in U.S. Pat. No. 5,314,774.

As photoreceptor belt 146 moves past each developer station, its surface is first erased and uniformly charged, followed by exposure in accordance with supplied pixel information from an associated TFEL image exposure device. The exposed image is then developed in the known manner, using the dry toner powder. Each subsequent developer module applies a different color toner in accordance with pixel charge states from a corresponding color plane. In such manner, a single pass dry powder EP printer is achieved wherein "backside" exposure is enabled.

Figure 10:
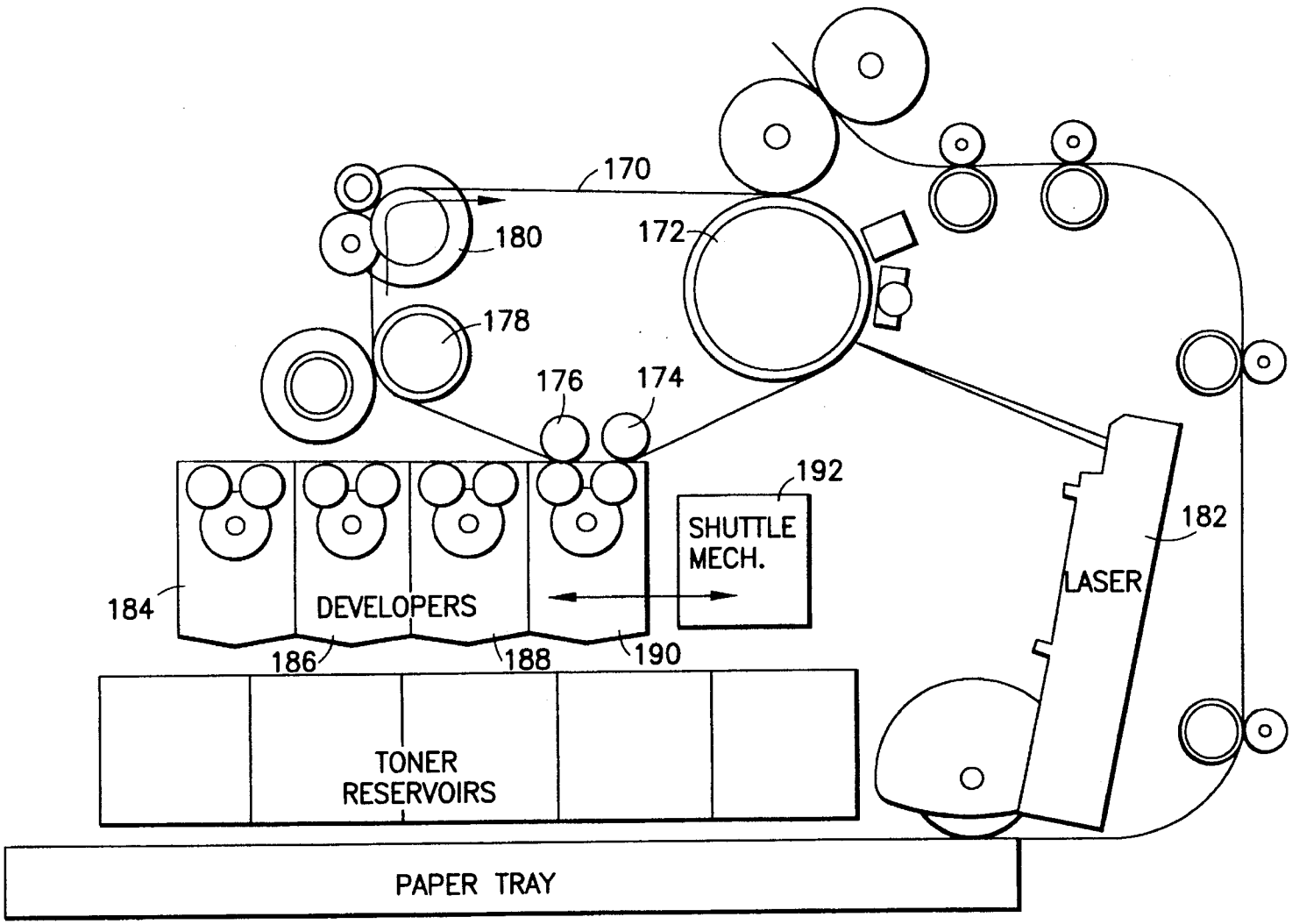
FIG. 10 is a schematic view of a four pass color EP printer wherein liquid toner developer modules are mounted on a shuttle so as to enable a more compact arrangement of the EP printer.

In FIG. 10, a four pass EP printer is employed which achieves compactness of design through use of a shuttle mechanism to move developer modules into contact with a photoreceptor web. More specifically, photoreceptor web 170 is threaded over a drive roller 172 and around follower rollers 174, 176, 178, and 180. A single laser scanner 182 operates to form latent image charge states on photoreceptor belt 170 in accordance with color plane pixel data for each pass of belt 170. The mechanism further includes a plurality of developer modules 184, 186, 188, and 190, each of which is dedicated to toning a single color liquid toner (in the manner aforedescribed).

Assuming that developer modules 184, 186, 188 and 190 contain black, magenta, yellow and cyan liquid toners, respectively, a shuttle mechanism 192 causes an appropriate developer module to move into contact with photoreceptor web 170 at follower rollers 176, 174. Thus, after laser scanner 182 images photoreceptor web 170 in accordance with pixel data from a cyan memory plane, toner module 190 is moved into contact with photoreceptor web 170. Upon a next rotation of photoreceptor web 170 past laser scanner 182, charge states in accordance with pixel data from a yellow memory plane are applied and shuttle mechanism 192 moves developer module 188 into contact with photoreceptor web 170, etc., etc. In such manner, a four pass color EP printer is constructed which is compact in structure and is therefore able to employ a shorter photoreceptor web 170.

It should be understood that the foregoing description is only illustrative of the invention. Various alternatives and modifications can be devised by those skilled in the art without departing from the invention. For instance, while the liquid toner aspects invention have been described in the context of a positively charged photoreceptor, a system employing a negatively charged photoreceptor also falls within the scope of the invention. Accordingly, the present invention is intended to embrace all such alternatives, modifications and variances which fall within the scope of the appended claims.

What is claimed is:

1. An electrophotographic color printer comprising:

a photoreceptor having a toner-receiving surface;

means for moving said photoreceptor in a first direction of movement;

plural exposure means arrayed along said toner-receiving surface of said photoreceptor for charging said photoreceptor in accordance with different color image pixel values;

a developer module associated with each exposure means, each said developer module including a liquid toner reservoir, a developer roll for carrying liquid toner to a transfer point, a squeegee roll for removing excess dispersant from said liquid toner after said liquid toner has been applied to said photoreceptor, said developer module maintaining said developer roll at a constant distance from said photoreceptor at said transfer point to create a fluid interfacial layer thereat between said developer roll and said photoreceptor, said developer module further maintaining said squeegee roll in constant engagement with said photoreceptor;

an erase means positioned upstream from each said exposure means in regards to said first direction of movement of said photoreceptor;

charge means positioned between each said erase means and a downstream exposure means;

a drying roll positioned after a last developer module for fixing a toner image on said photoreceptor; and means for transferring said toner image to a sheet.

2. The electrophotographic color printer as recited in claim 1, wherein said photoreceptor is a web, said toner-receiving surface being a release layer, said web further comprising a plurality of layers positioned above said release layer, said layers including: a charge generation layer, a charge transport layer, and a substrate/ground plane layer.

3. The electrophotographic color printer as recited in claim 2 whereon said layers are positioned above said release layer in the order recited.

4. The electrophotographic color printer as recited in claim 2 wherein each of said plural exposure means includes a scanned laser beam generator.

5. The electrophotographic color printer as recited in claim 2 wherein each of said plural exposure means comprises a linear array of edge-emitting optical transmitters juxtaposed to said toner-receiving surface of said photoreceptor.

6. The electrophotographic color printer as recited in claim 1 wherein only a single drying roll is positioned in contact with said photoreceptor.

7. The electrophotographic color printer as recited in claim 1, further comprising:

plural additional drying rolls, each drying roll positioned immediately downstream in said first direction of movement from an associated developer module.

8. The electrophotographic color printer as recited in claim 1 wherein said photoreceptor is a web and wherein said toner-receiving surface comprises a release/overcoat layer and further includes a stack of layers positioned thereon in a following order: a charge generation layer, a charge transport layer, a transparent ground plane layer, and a transparent support comprising an upper surface of said photoreceptor, and wherein each said exposure means is an array of edge emitting optical transmitters juxtaposed to said transparent support and over said upper surface.

9. A single pass electrophotographic color printer, comprising:

a charged photoreceptor web having a toner-receiving surface, a transparent ground plane layer and a transparent support;

means for moving said photoreceptor web in a first direction of movement;

plural arrays of edge emitting optical transmitters juxtaposed to said transparent support of said photoreceptor web, each optical transmitter adapted to discharge said charged photoreceptor web in accordance with color image pixel signals;

a developer module associated with each said optical transmitter, each said developer module positioned in a downstream direction of movement of said photoreceptor web from an associated optical transmitter, each said developer module including a powder toner reservoir, a developer roll for carrying powder toner to a transfer point for transfer to said photoreceptor web, a biasing roll in contact with said developer roll for causing said powder toner to develop a charge, said developer module maintaining said developer roll a constant distance from said photoreceptor web at said transfer point so as to create a toner transfer position between each said developer roll and said photoreceptor web;

erase means positioned upstream in regards to said direction of movement from each optical transmitter and juxtaposed to said photoreceptor web;

charge means positioned between each said erase means and a developer module; and means for transferring said image toner to a sheet.

* * * * *